US006499154B1

(12) United States Patent
Niibayashi

(10) Patent No.: US 6,499,154 B1
(45) Date of Patent: Dec. 31, 2002

(54) BUBBLE JETTING APPARATUS

(75) Inventor: Takafumi Niibayashi, Hiroshima (JP)

(73) Assignee: Vib Tec Limited Company, Hiroshima-Ken (JP)

( * ) Notice: Subject to any disclaimer, the term of this patent is extended or adjusted under 35 U.S.C. 154(b) by 0 days.

(21) Appl. No.: 09/625,280

(22) Filed: Jul. 25, 2000

(30) Foreign Application Priority Data

Jul. 28, 1999 (JP) ..... 11-213198

(51) Int. Cl.[7] ..... A61H 33/06
(52) U.S. Cl. ..... 4/541.5
(58) Field of Search ..... 4/541.4, 541.5

(56) References Cited

U.S. PATENT DOCUMENTS 4,052,757 A * 10/1977 Dotson ..... 4/489 X
4,100,917 A * 7/1978 Talge et al. ..... 4/541.6 X
4,240,166 A * 12/1980 Altman et al. ..... 4/541.4
4,924,069 A * 5/1990 Giordani ..... 4/541.4 X

FOREIGN PATENT DOCUMENTS

JP 61-136726 6/1986 ..... A61H/23/00
JP 5-137764 6/1993 ..... A61H/23/00
JP 6-304219 11/1994 ..... A61H/23/00
JP 10-295761 11/1998 ..... A61H/23/00

* cited by examiner

*Primary Examiner*—Charles E. Phillips
(74) *Attorney, Agent, or Firm*—Sughrue Mion, PLLC

(57) ABSTRACT

The invention has an object to provide a bubble jetting apparatus which is simple in structure, can be easily installed in an existing bathtub without its apparatus body being installed in a bathtub, and excellent in use efficiency and various applications, and by which various features such as bubbles, jet streams and bubble jets can be freely selected. The bubble jetting apparatus has a apparatus body comprising a circulating pump 4, a suction tube 5 connected to the suction side of the circulating pump 4, a discharge tube 6 connected to the discharge side of the circulating pump 4, one or more bubble generating portions 7 disposed at appointed positions of the discharge tube 6, a compressor 8 connected to the bubble generating portions 7, and a drive portion 11 connected to the circulating pump 4 and compressor 8.

9 Claims, 7 Drawing Sheets

BUBBLE JETTING APPARATUS

FIELD OF THE INVENTION

The present invention relates to a bubble jetting apparatus which can be easily installed in an existing bathtub and can discharge bubbles, jet streams, or bubble jets into bath water, etc., in a bathtub.

BACKGROUND OF THE INVENTION

Conventionally, a bathtub is installed in respective houses, accommodation facilities, etc., such as hotels, inns, etc., in order to take a bath. Also, recently, in order to take a further comfortable bath, a bathtub equipped with a bubble jetting feature has been proposed, which can discharge bubbles, jet streams, or bubble jets having a massage effect.

In prior art bathtubs having a bubble jetting feature, there are some type in which a bubble jetting apparatus is installed integral with a bathtub body or a bubble jetting apparatus is detachably installed in a bathtub.

For example, as those in which a bubble jetting apparatus is installed integral with a bathtub, in Japanese Laid-Open Patent Publication No. 136726 of 1986 (hereinafter called Publication "A"), such a bubble bathtub is disclosed, in which a hot water outflow port and a hot water inflow port are provided in a bathtub, wherein these hot water outflow and inflow ports are connected to each other by using a pipe. In the path of piping, a pump intervenes, which takes in hot water in the bathtub and jets the same into the bathtub through the hot water inflow port, and wherein an air supplying portion is installed in the pipe positioned at the suction side of the pump.

In Japanese Laid-Open Patent Publication No.137764 of 1993 (hereinafter called Publication "B"), a bubble jet generating apparatus is disclosed, which comprises an air-water mixing portion which sucks in air by an inflow water ejector effect, a rectification portion which rectifies and leads an air-water mixed fluid of the air-water mixing portion, and a jetting portion, having a convex-shaped curved line disposed at least at the inlet side with respect to a stream connecting a large-diametered inlet end to a small-diametered outlet end, which is provided at the outlet of the rectification portion in a watertight state with its flow direction made variable, and jets the air-water mixed fluid from the outlet end into the water.

Further, in Japanese Laid-Open Patent Publication No. 304219 of 1994 (hereinafter called Publication "C"), a jetting nozzle device which jets bubble-mixed jets into a bathtub is provided in the vicinity of a circulating pump circulating bath water in a bathtub integral therewith as a bubble jetting apparatus detachably installed in a bathtub. Publication "C" discloses a water jetting apparatus for a bath, for which the circulating pump and jetting nozzle device are detachably disposed roughly horizontally inside a bathtub wall.

In Japanese Laid-Open Patent Publication No. 295761 of 1998 (hereinafter called Publication "D"), an in-bath bubble generating apparatus is disclosed, which comprises an apparatus body internally having a pump portion, which discharges sucked bath water as a water stream, an air intake portion for mixing air into the water stream, and a nozzle portion, communicating with the pump portion, which jets air bubbles outside the apparatus body along with the water stream, wherein a roughly rectangular box-like wing type jetting body provided with a plurality of jetting ports is detachably and rotatably provided at the nozzle portion, and the plurality of jetting ports are made open and juxtaposed at a side facing the nozzle portion and a side opposite thereto.

SUMMARY OF THE INVENTION

However, these prior art bubble jetting apparatuses still have the following shortcomings and problems.

In a bubble bath described in Publication "A", since an outflow port and an inflow port are provided in a bathtub, the outflow port is connected to the inflow port by a pipe, and a pump and an air inflow portion are provided in the pipe, wherein the bubble bath cannot be attached to an existing bathtub as completed, and it is not suitable for universal applications. Also, since it is necessary to replace the bathtub and piping attached thereto, specified work such as piping, etc., is further required for installation of the corresponding bubble bath tab, and the installation efficiency is inferior. Further, a long working period and cost are required for installation thereof. That is, Publication "A" has such shortcomings and problems.

In a bubble jet generating apparatus disclosed by Publication "B", since an air-water mixing portion and a rectification portion are installed in the vicinity of a water stream nozzle portion, and the rectification has a convex-shaped curved line in a stream connecting a large-diametered inlet end to a small-diametered outlet end, the structure of the corresponding bubble jet generating apparatus is complicated, resulting in a lowering of production efficiency and an increase in maintenance work. Also, since the apparatus body is large-sized, it is difficult to attach the same to an existing bathtub, and it is not suitable for universal applications, whereby in attaching the corresponding bubble jet generating apparatus, replacement of a bathtub and further piping work, etc., is required, resulting in a lowering of work efficiency. That is, Publication "B" also has such shortcomings and problems.

In a jetting device disclosed by Publication "C" for a bath, since the corresponding jetting device for a bath is attached to an opening portion of the bath wall, an opening of such a size, by which the corresponding jetting device for a bath can be installed, is required on the bath wall surface, and at the same time, space necessary for the corresponding jetting device to be inserted is required on the outer circumferential side of a bathtub, whereby it is difficult for the jetting device to be installed in an existing bathtub after being completed, and it is not suitable for universal applications. Also, since a jetting nozzle device is installed in the vicinity of a circulating pump integral therewith, the jetting nozzle device is fixed at an appointed position, whereby the jetting port cannot be moved in compliance with the positions of the shoulders, waist, legs, etc., of a user, wherein use efficiency is reduced. That is, such shortcomings and problems as described above still remain.

In an in-bath bubble generating apparatus disclosed in Publication "D", since the entire corresponding in-bath bubble generating apparatus is installed in a bathtub, the bath is made narrow, the apparatus may hinder bathing, whereby the efficiency and convenience in use are remarkably spoiled. Further, the entire apparatus is installed in a bathtub, and a waterproof measure is further required for the entirety of the apparatus. Production efficiency is worsened, and further maintenance is required. Still further, since the apparatus is installed in a bathtub, compactness thereof is requisite, whereby the intensity and performance of bubble streams or jets are made inferior to those of a bubble jetting apparatus installed integral with a bathtub body. Therefore, use efficiency is reduced. That is, such shortcomings and problems as described above remain.

The present invention was developed in order to solve the shortcomings and problems remaining in the prior arts, and it is therefore an object of the invention to provide a bubble jetting apparatus, which structure is simple, not requiring installation of the apparatus body in a bathtub, which can be easily attached to an existing bathtub, can be used by selecting respective features of air bubbles, water jet streams and bubble jets and is excellent in use efficiency, universal applications and performance of the respective features.

In order to solve the abovementioned shortcomings and problems, a bubble jetting apparatus according to the invention has been constructed as described below.

A bubble jetting apparatus in accordance with Aspect 1 of the invention is provided with an apparatus body which comprises a circulating pump, a suction tube connected to the suction side of the circulating pump, a discharge tube connected to the discharge side of the circulating pump, one or more bubble generation portions disposed at an appointed position of the discharge tube, a compressor connected to the bubble generating portions, and a drive portion connected to the circulating pump and compressor.

With the above construction, a bubble jetting apparatus according to the invention has the following actions:

(a). Since a circulating pump and a compressor are connected to a one drive portion, no separate drive portions are required to drive the circulating pump and compressor, whereby the drive portion can be made compact and small-sized, and at the same time, the entire apparatus can be made small-sized.

(b). Since a bubble generating portion connected to the compressor is provided at an appointed portion of a discharge tube, air bubbles can be supplied into the discharge tube and mixed in bath water which is sucked by the circulating pump and supplied to the discharge tube, whereby air bubble jets can be discharged through the discharge tube.

(c). In a case where a plurality of bubble generation portions are provided, it is possible to regulate the bubble supply amount, and in particular, in a case where a bubble generating portion for generating various sizes of air bubbles is installed, it is possible to easily change the size of air bubbles in compliance with applications.

Herein, a self suction type circulating pump and a non-self suction type circulating pump may be used as the circulating pump. Further, an electric motor, etc., may be used as a drive portion, wherein by changing the number of revolutions of the motor, the discharge pressure and quantity of bubble jets can be adjusted.

Further, in a case where a plurality of bubble generating portions are provided, these portions may be installed with the hole diameter and/or number of holes of respective bubble discharge portions changed, whereby it is possible to adjust the size of bubbles and bubble supply quantity.

A bubble jetting apparatus according to Aspect 2 of the invention, further comprises, in addition to the invention described in Aspect 1, an extended suction tube portion, an end of which is disposed in bath water in a bathtub, connected to the suction tube of the apparatus body, a bubble jetting and discharging tube connected to the discharge tube, and a bubble jetting and discharging portion connected to the bubble jetting and discharging tube.

Thereby, a bubble jetting apparatus will have the following actions;

(a). Since an extended suction tube portion having one end thereof disposed in bath water in a bathtub is provided, only the extended suction tube portion is installed in a bathtub, and bath water can be sucked in by the circulating pump. Since a bubble jetting and discharging tube connected to the discharge tube is provided, such an action can be brought about, by which it is possible to install only the bubble jetting and discharging portion in a bathtub or in the vicinity of a bathtub without providing the entire apparatus in a bathtub, the apparatus body may be installed at any place in a bathroom distant from a bathtub or outside a bathroom.

(b) Since the entire apparatus may be installed at any place in a bathroom distant from a bathtub or outside the bathroom, it is easy to secure a power source, etc., whereby the apparatus body can be easily installed. Therefore, it is possible to easily attach the apparatus to an existing bathtub once the bath is completed, and since the apparatus body is not installed in a bathtub, it does not hinder bathing.

Herein, a tubular member having flexibility such as a hose, etc., may be preferably used as an extended suction tube portion. Accordingly, the extended suction tube portion may be installed at any optional place in a bathtub, thereby preventing it from hindering bathing. Further, a filtering portion consisting of a filter, etc., may be disposed at an end or an appointed position of the extending suction tube portion, or at an appointed position, etc., of a suction tube. Thereby, it is possible for the filtering portion to catch floating matter such as hair, etc., which may be sucked in through the extended suction tube portion during bathing, whereby bath water can be filtrated to prevent such floating matter from flowing into the suction tube, circulating pump, discharge tube, etc. Also, a cup-like formed suction preventing member, made of a synthetic resin, etc., having a number of holes at its wall surface, or a cup-like formed suction assisting member made of a meshed metal plate may be externally attached to the end of the extended suction tube portion, whereby the suction area of the end portion of the extended suction tube portion can be widened, and it is possible to prevent such a state from occurring, where a towel, etc., is sucked into the end portion of the extended suction tube portion to prevent suction of bath water, resulting in the sucked object being sucked into the circulating pump with the bath water being shut out.

A tubular member, etc., having flexibility such as a hose, etc., may be used as a bubble jetting and discharging tube.

As a bubble jetting and discharging portion, those described below may be optionally used, that is, they includes a member having one end thereof connected to a bubble jetting and discharging tube and having one or more bubble jetting and discharging outlets at the other end thereof, a member consisting of one or more detaching portions formed at one end thereof of a bubble jetting and discharging tube, and a flexible tubular body detachably connected to the detaching portion and a bubble jetting and discharging outlet at one end thereof, and a hollow mat-like member having a flexible tubular body connected to a bubble jetting and discharging tube and a plurality of bubble jetting and discharging outlets connected to the flexible tubular body, disposed on the bottom of a bathtub and located on the upper surface thereof. These may be hand-held by a user, fixed by a sucking-disk on the inner wall and bottom of a bathtub or on a wall of a bathroom, or may be used detachably in engagement with a fixing member secured on a wall surface of a bathtub or bathroom. Also, as the bubble jetting and discharging outlet at the bubble jetting and discharging portion through which bubble jets are discharged, a nozzle shape or such a type which can smoothly discharge bubble jets into bath water can be preferably used particularly in a case where bubble jets are discharged into bath water.

A bubble jetting apparatus according to Aspect 3 of the invention has such a construction in which, in addition to the invention described in Aspects 1 or 2, one or more of either a clutch, a speed reducer or a speed accelerator is equipped between the drive portion, and the circulating pump and/or the compressor.

With such a construction as described above, the following actions can be brought about.

(a) Where a clutch is provided at the drive portion, a drive mode can be changed, by the clutch, to either of a drive of the circulating pump, drive of the compressor, or drive of both the circulating pump and compressor, wherein such an action can be brought about, by which it is possible to optionally select either of only bubbles, only water jet streams or both bubbles and water jet streams by using the corresponding bubble jet apparatus, and to discharge the same through the bubble jetting and discharging portion.

(b) Where a speed reducer or a speed accelerator is provided in the drive portion, drive forces required to drive both the circulating pump and compressor can be obtained by one unit of the drive portion even though the drive forces of the circulating pump and compressor are different from each other, whereby such an action can be brought about, by which the drive portion can be made small-sized. In particular, where an electric motor is employed as the drive portion, it is possible to vary a drive force by the speed reducer and speed accelerator according to the circulating pump and compressor. Therefore, such an action can also be brought about, by which the circulating pump and compressor are connected to one unit of the motor and can be driven.

(c). In a case where a speed reducer and a speed accelerator are provided at the drive portion, the circulating pump and compressor are connected to a motor of the drive portion via the speed reducer and speed accelerator, the number of revolutions of only either the circulating pump or the compressor can be varied, whereby it is possible to adjust discharge pressure of bubbles or water jet streams, thereby further improving use efficiency thereof.

Herein, any optional type of clutch such as an electromagnetic clutch, a mechanical clutch, an electric clutch, a hydraulic clutch, etc., may be used, and it can be connected to the circulating pump side and/or the compressor side of the drive portion.

A bubble jetting apparatus according to Aspect 4 of the invention is featured in that, in addition to the invention described in any one of Aspects 1, 2 and 3, the bubble generating portion comprises a compressed air supplying tube having one end thereof connected to the compressor, an air supplying chamber connected to the compressed air supplying tube and disposed in the discharge tube, and a bubble discharging hole portion drilled on the circumferential wall of the air supplying chamber.

With such a construction as described above, the following actions can be provided.

(a). Compressed air can be supplied into an air supplying chamber via a compressed air supplying tube by only driving the compressor by the drive portion, and the compressed air supplied into the air supplying chamber can be discharged from the bubble discharging hole portion into the discharge tube, whereby such an action can be brought about, which can supply bubbles into the discharge tube.

(b). Since a bubble discharging hole portion is provided, bubble streams whose bubble size is uniform can be obtained, whereby the massage effect can be increased, and by only changing the bubble discharging hole portion, a desired bubble size can be obtained.

Herein, a plurality of bubble discharging hole portions are provided on the circumferential wall of the bubble supplying chamber. Further, the bubble discharging hole portion may be made into a nozzle type, whereby bubbles can be smoothly supplied in bath water in the discharge tube where bath water is supplied into the discharge tube.

Also, the size of bubbles can be changed by the size of the bubble discharge hole portion. Further, in a case where bubble generating portions are disposed at a plurality of points of the discharge tube, it is preferable to use bubble generating portions in which the diameters of the bubble discharging hole portions are different from each other, whereby the sizes of bubbles supplied into the discharge tube can be changed per bubble generating portion.

In addition, a change valve or a check valve may be provided at appointed positions of the compressed air supplying tube to which a bubble generating portion and a compressor are connected, whereby it is possible to prevent bath water, etc. from inversely flowing into the compressor side when no bubbles are supplied into the discharge tube.

Also, instead of an air supplying chamber, a porous body made of ceramic, etc., is connected to the compressed air supplying tube and may be disposed in the discharge tube, whereby bubbles can be supplied from the holes of the porous body into the discharge tube, and it is possible to provide small-diametered bubbles.

Further, instead of forming a bubble discharging hole portion on the circumferential wall of the air supplying chamber, one or more nozzles may be connected to the air supplying chamber, whereby bubbles can be supplied into the discharge tube as in the bubble discharging hole portion.

A bubble jetting apparatus according to Aspect 5 of the invention is constructed, in addition to the invention in any one of Aspects 1 through 4, so as to comprise a hot water supplying tube, one end of which is connected to the suction tube, and the other end of which is connected to a hot water supplying portion, and a change valve disposed at the hot water supplying tube and/or the suction tube.

Thereby, the following actions can be brought about.

(a). Since hot water can be supplied into the suction tube or discharge tube from the hot water supplying portion through the hot water supplying tube, the remaining water left in the suction tube and discharge tube can be discharged by supplying hot water from the hot water supplying portion to the suction tube and discharge tube particularly when the corresponding bubble jetting apparatus is driven and started, and the remaining water left in the suction tube and discharge tube can be circulated, so that no remaining water is discharged into bath water in a bathtub, whereby such an effect can be brought about, by which the sanitary state can be improved.

(b). In particular, in a case where a non-self suction pump is used as a circulating pump, since hot water can be supplied from the hot water supplying portion to the suction tube and discharge tube when driving and starting the corresponding bubble jetting apparatus, such an effect can be brought about, by which stability can be maintained when driving the circulating pump.

(c). Since a change valve is provided, which is disposed in the hot water supplying tube and/or suction tube, hot water from the hot water supplying portion can be supplied to appointed tubes such as the suction tube, and discharge tube, etc., and at the same time, it is possible to prevent bath water from flowing into the hot water supplying tube when bath water is circulated.

Herein, by a screw-in means, other fitting means or the like, the hot water supplying tube may be detachably connected to the hot water supplying portion such as a faucet, etc., for water service, a hot water supply, etc. Also, in particular, where a piping channel of the suction tube and discharge tube is long, it is preferable to supply hot water to the hot water supplying tube, whereby it is possible to prevent the temperature of bath water from being lowered when hot water in the suction tube and discharge tube is discharged into bath water.

Also, in particular, where a faucet is provided, which is capable of directly supplying hot water from a hot water supply to a bathtub, the hot water supplying tube may be connected to the faucet, and hot water for bathing may be supplied into a bathtub via the hot water supplying tube, water supply tube, and discharge tube.

An electric change valve such as a solenoid valve, a motor-driven type valve, etc., may be used as a change valve. Further, the change valve is disposed from an appointed portion of the hot water supplying tube and a connection portion, to which the hot water supplying tube and suction tube are connected, to the suction tube at the extended suction tube side, the suction tube at the circulating pump side, and so on.

A bubble jetting apparatus according to according to Aspect 6 of the invention is constructed, in addition to the invention in any one of Aspects 1 through 5, to a flexible tubular body connected to the bubble jetting and discharging tube, and a bubble jetting and discharging member connected to the flexible tubular body.

Thereby, the following effect can be brought about.

(a). Since the bubble jetting and discharging member is connected to the bubble jetting and discharging tube via a flexible tubular member, the bubble jetting and discharging member may be freely moved to any position in a bathtub, whereby it is possible to apply bubbles, water jet streams and bubble jets to various positions of the user's body such as the shoulders, waist, legs, etc.

Herein, the bubble jetting and discharging member may have one or more bubble jetting and discharging ports in compliance with the position or the like of application such as shoulders, waist, legs, etc., or hollow mat-like members, etc., having a plurality of bubble jetting and discharging ports thereon may be used. Also, it is preferable that bubble jetting and discharging members are detachably connected to a flexible tubular member by a fitting and screw-in, etc., using a latch or screws, etc., whereby the bubble jetting and discharging member can be easily replaced by a bubble jetting and discharging member in which the number of bubble jetting and discharging ports are different or another bubble jetting and discharging member whose shape is different, in compliance with a user or application positions. Also, a bubble jetting and discharging member, in which the bubble jetting and discharging port can be changed to any direction vertically or horizontally (left and right), may be used. Thereby, it is possible to change only the discharge direction of bubble jets without changing the disposed position of the bubble jetting and discharging member. In addition, a stopping member, by which a bubble jetting and discharging member is fixed, is fixed on the inner wall, bottom of a bathtub or on the wall surface of a bathroom, by using a sucking-disk, etc., wherein the bubble jetting and discharging member may be fixed in the stopping member for use. Also, a fixing member such as a sucking-disk, etc., may be attached to the bubble jetting and discharging member. Therefore, the bubble jetting and discharging member may be used without being hand-held by a user during using the corresponding bubble jet apparatus, whereby use efficiency can be further improved.

A hose, etc., may be used as a flexible tubular body, and it may be formed on the bubble jetting and discharging tube detachably or integral therewith. Also, the bubble jetting and discharging tube and flexible tubular body may be formed integral with each other or the bubble jetting and discharging tube may be made flexible. In addition, where a flexible tubular body is detachably connected to the bubble jetting and discharging tube, a detaching portion consisting of one or more latches and screws, etc., by which the flexible tubular body is connected to the end portion of the bubble jetting and discharging tube, may be formed. Therefore, the flexible tubular body can be detachably attached to the bubble jetting and discharging tube, and where not in use, the flexible tubular body is removed, or the bubble jetting and discharging port can be directly attached to the detaching portion, whereby use efficiency can be further improved.

BRIEF DESCRIPTION OF THE DRAWINGS

The foregoing and other features and advantages of the present invention will become more readily more appreciated as the same becomes better understood by reference to the following detailed description when taken into conjunction with the accompanying drawings wherein.

DESCRIPTION OF PREFERRED EMBODIMENTS (Embodiment 1)

A description is given of a bubble jetting apparatus in the embodiment example 1 of the invention, with reference to the accompanying drawings.

Figure 1:
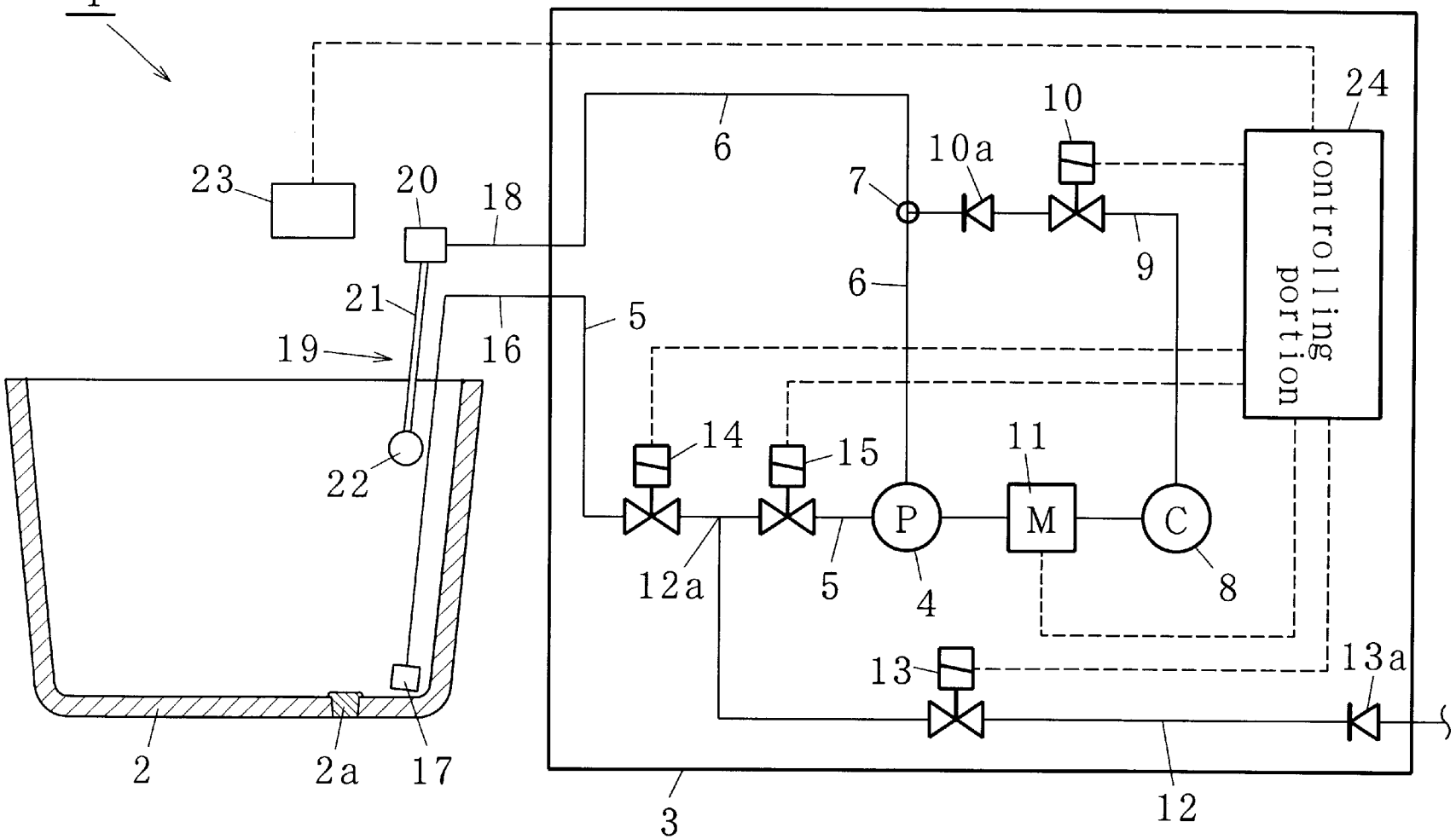
FIG. 1 is an explanatory view of a bubble jetting apparatus according to the first embodiment.

FIG. 1 is an explanatory view of a bubble jetting apparatus according to the first preferred embodiment.

In FIG. 1, 1 indicates a bubble jetting apparatus in a first preferred embodiment. 2 indicates an existing bathtub installed in a bathroom, wherein 2*a* indicates a bathtub plug disposed on the bottom of the bathtub. 3 indicates the apparatus body of the bubble jetting apparatus 1. 4 indicates a circulating pump of the apparatus body 3. 5 indicates a suction tube connected to the suction side of the circulating pump 4. 6 indicates a discharge tube connected to the discharge side of the circulating pump 4. 7 indicates a bubble generating portion disposed in the discharge tube 6. 8 indicates a compressor connected to the bubble generating portion 7. 9 indicates a compressed air supplying tube, connected to the compressor 8, which consists of a high pressure hose, etc., of the bubble generating portion 7, 10 indicates a change valve, which consists of a solenoid valve disposed at the compressed air supplying tube 9, wherein 10*a* indicates a check valve disposed at the compressed air supplying tube 9 at the discharge tube 6 side of the change valve 10. 11 indicates a drive portion consisting of a motor which is connected to the circulating pump 4 and compressor 8 and drives the circulating pump 4 and compressor 8. 12 indicates a hot water supplying tube, one end of which is connected to the suction tube 5 and the other of which is connected to a hot water supplying portion (not illustrated) of a water system and a hot water supply, etc., wherein 12*a* indicates a connection portion which connects the hot water supplying tube 12 and suction tube 5. 13 indicates a change valve disposed at the hot water supplying tube 12, wherein 13*a* indicates a check valve disposed at the hot water supplying tube 12. 14 indicates a change valve disposed from the connection portion 12*a* to the suction tube 5 at the bathtub 2 side. 15 indicates a change valve disposed from the connection portion 12*a* to the suction tube 5 at the circulating pump 4 side. 16 indicates an extended suction tube portion, the end portion of which is disposed in a bathtub 2, connected to the suction tube 5. 17 indicates a suction portion internally incorporating a filtrating portion, consisting of a filter, etc., and disposed at the end portion of the extended suction tube portion 16. 18 indicates a bubble jetting and discharging tube connected to the discharge tube 6. 19 indicates a bubble jetting and discharging portion connected to the bubble jetting and discharging tube 18. 20 indicates a detaching portion connected to the end portion of the bubble jetting and discharging tube 18 and consisting of a latch, screws, etc. 21 indicates a flexible tubular member of the bubble jetting and discharging portion 19, which is detachably connected to the detaching portion 20 and consists of a hose, etc., 22 indicates a bubble jetting and discharging member of the bubble jetting and discharging portion 19, which is detachably connected to the end portion of the flexible tubular member 21 by screw-in, etc., 23 indicates an operating portion of the bubble jetting apparatus 1, and 24 indicates a controlling portion of the bubble jetting apparatus 1.

Herein, a self suction type or a non-self suction type circulating pump may be used as the circulating pump 4. Where the extended suction tubular portion 16 is short or the disposed position thereof is low, a non-self suction type circulating pump may be preferably used. Also, where the extended suction tubular portion 16 is long or the disposed position thereof is high, requiring a high suction force, a self suction type circulating pump is preferably employed. Therefore, in either case, bath water in a bathtub 2 can be sucked in a stabilized state, whereby the stability in drive of the circulating pump 4 can be maintained.

Also, in the drive portion 11, a speed accelerator or speed reducer may be connected to the motor, whereby even though the numbers of motor revolutions of the drive portion 11, which is required to drive the circulating pump 4 and compressor 8, are different from each other, the circulating pump 4 and compressor 8 may be connected to one unit of the drive portion 11 via the speed accelerator and speed reducer and can be thereby driven.

Further, in the first embodiment, the extended suction tubular portion 16 and bubble jetting and discharging tube 18 may be made of a flexible material such as a hose, etc. Also, a solenoid valve can be used as change valves 10, 13, 14 and 15.

Next, a description is given of the bubble generating portion 7 with reference to the accompanying drawings.

Figure 2:
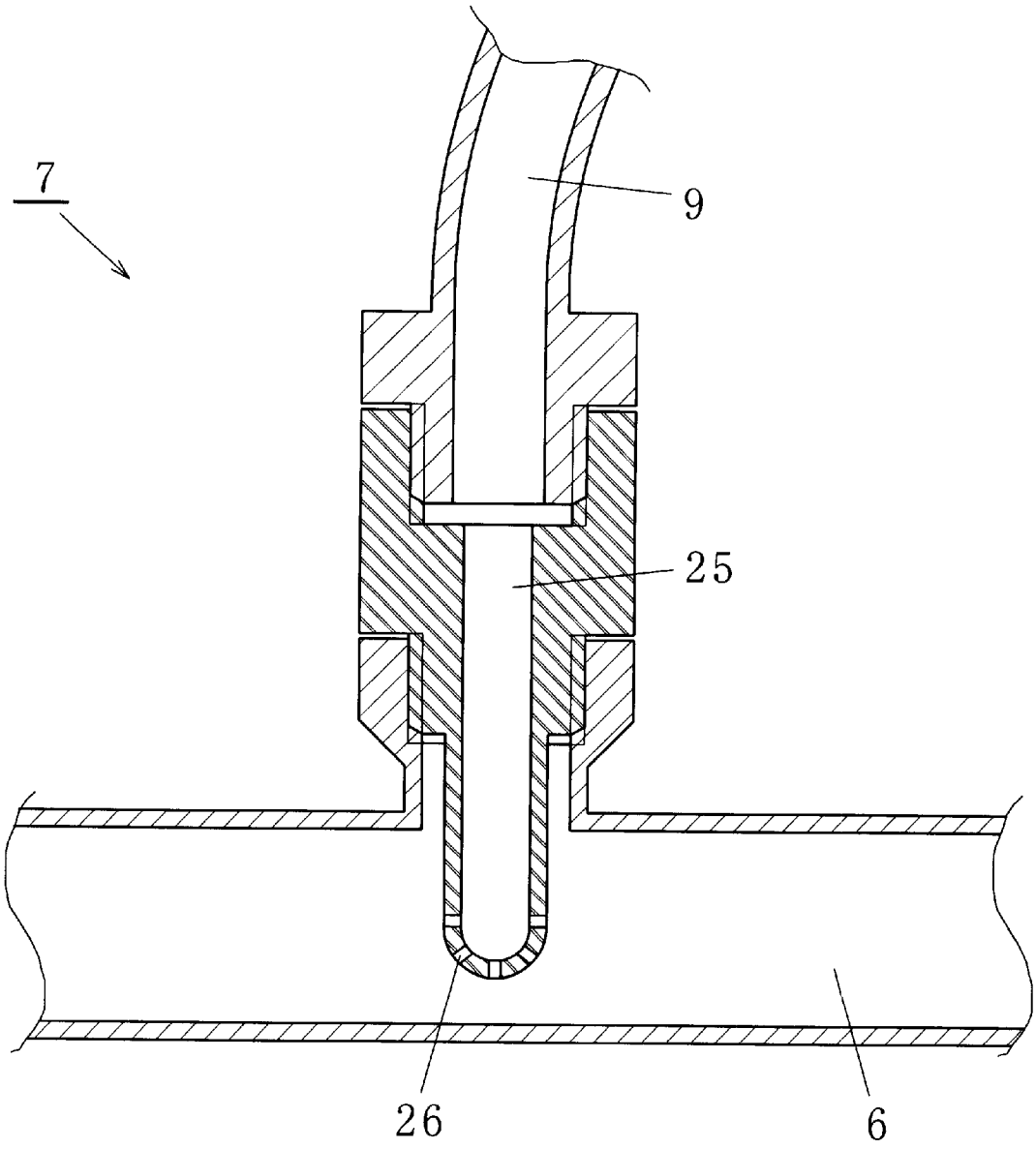
FIG. 2 is a cross-sectional view of the major parts of a bubble jetting apparatus according to the first preferred embodiment.

FIG. 2 is a cross-sectional view showing the major parts of a bubble generating portion of a bubble jetting apparatus according to the first embodiment, wherein 25 indicates an air supplying chamber, connected to the compressed air supplying tube 9 and discharge tube 6, the end portion of which is disposed in the discharge tube 6, 26 indicates a plurality of bubble discharging holes disposed in the discharge tube 6 and drilled on the circumferential wall of the air supplying chamber 25. Also, the bubble discharging holes 26 maybe formed like a nozzle, whereby bubbles can be smoothly supplied into bath water.

With respect to an example in which a bubble jetting apparatus thus constructed according to the first embodiment is used in an existing bathtub in a hotel or so on, the use is described with reference to the accompanying drawings.

Figure 3:
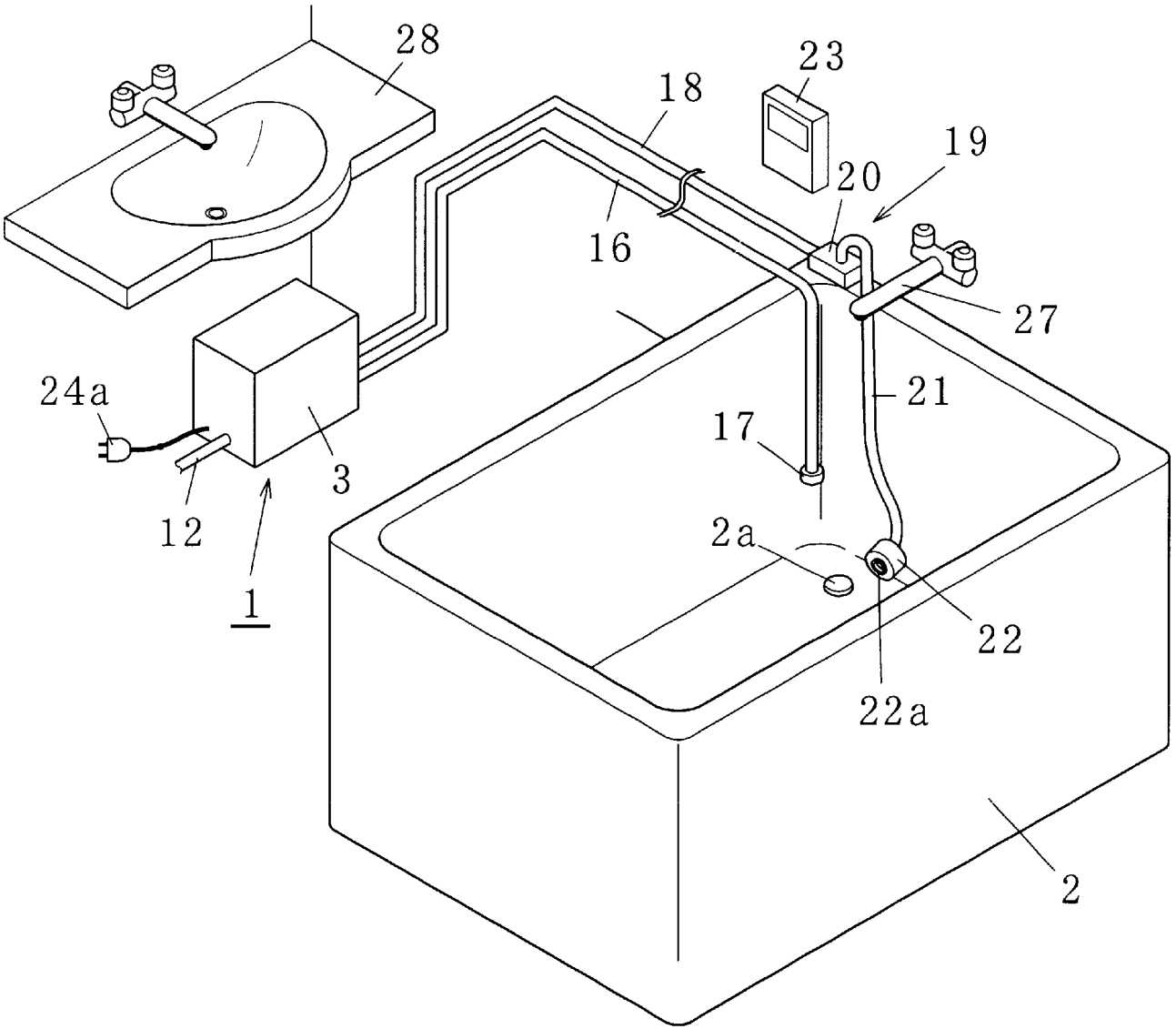
FIG. 3 is a perspective view showing a state where a bubble jetting apparatus according to the first embodiment is installed in a bathroom in a hotel or the like, FIG. 4 is a cross-sectional view of the major parts of a suction portion in the first embodiment, FIG. 5(*a*) is a front elevational view of the major parts, showing a bubble jetting and discharging member having two bubble jetting and discharging ports in the first embodiment, FIG. 5(*b*) is a side elevational view of the major parts in FIG. 5(*a*)
Figure 4:
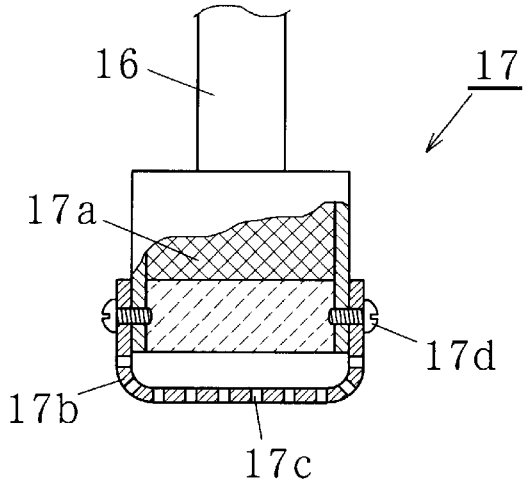

FIG. 3 is a perspective view showing a state where the bubble jetting apparatus according to the first preferred embodiment is installed in a bathroom in a hotel or the like, and FIG. 4 is a cross-sectional view showing the major parts of a suction portion in the first preferred embodiment.

In FIG. 3, 22*a* indicates a bubble jetting and discharging port of a bubble jetting and discharging member 22, 24*a* indicates a power source of the bubble jetting apparatus 1. 27 indicates a faucet disposed on the wall surface of a bathroom in which a bathtub is installed. 28 indicates a washbowl, below which the apparatus body 3 is installed, apart from the bathtub 2 in the bathroom.

In FIG. 4, 17*a* indicates a filtrating portion of a filter, etc., disposed inside the suction portion 17, 17*b* indicates a suction preventing member, which is formed to be cup-like larger than the suction portion 17, made of synthetic resin, and is fitted to the outside of the suction portion 17, 17*c* indicates a plurality of holes drilled on the wall surface of the suction preventing member 17*b*, and 17*d* indicates a screw part by which the suction preventing member 17*c* is fixed at the suction portion 17. Also, a mesh-like metal made member may be used as a suction preventing member 17*b*.

In a case where the bubble jetting apparatus is used in an existing bathtub 2 in a hotel or the like, the apparatus body 3 is installed downward of a washbowl 28 or the like in a bathroom, and a hot water supplying tube 12 is connected to pipes of the washbowl, etc., and a hot water supplying tube of a hot water supply, etc., and the power source 24*a* is inserted into a plug attachment (socket).

Next, the suction portion 17 disposed at the end portion of the extended suction tubular portion 16 is disposed in a bathtub 2. Also, the detaching portion 20 of the bubble jetting and discharging portion 19 connected to the air jetting and discharging tube 18 is disposed at the edge part of the bathtub 2.

When using the bubble jetting apparatus 1, the flexible tubular member 21 is connected to the detaching portion 20 by a fitting, screw-in, etc., and as shown in FIG. 3, the bubble jetting and discharging portion 19 is connected to the bubble jetting and discharging tube 18.

Herein, where no space for installing the apparatus body 3 is secured in a bathroom, an insertion hole for inserting the bubble jetting and discharging tube 18 and extended suction tube portion 16 is provided on a wall portion of a washroom, etc., adjacent to the bathroom, wherein the apparatus body 3 maybe installed outside the bathroom such as an adjacent washroom, etc.

Next, a description is given of actions of the bubble jetting apparatus 1, using FIG. 1 through FIG. 3.

The bathtub plug 2*a* of the bathtub 2 is made open before supplying hot water into the bathtub 2. Next, the remaining water of the bubble jetting apparatus 1 is discharged by the operating portion 23. By starting of the remaining water discharge action of the bubble jetting apparatus 1, the change valve 15 is closed, and the change valves 13 and 14 are made open, whereby hot water is supplied from the connection portion 12*a* to the extended suction tube portion 16 and the suction tube 5 at the extended suction tube portion 16 side via the hot water supplying tube 12, and the remaining water left in the suction tube 5 is discharged from the suction portion 17 to a bathtub 2. Next, the change valve 14 is closed and the change valves 13 and 5 are opened, and at the same time, the change valve 10 is closed, whereby hot water is supplied from the connection portion 12*a* into the suction tube 5 at the circulating pump 4 side and into the discharge tube 6 via the hot water supplying tube 12. Accordingly, the remaining water left in the suction tube 5 and discharge tube 6 is discharged from the bubble jetting and discharging member 22 into a bathtub 2. Thereafter, the change valve 13 is closed. Herein, hot water that is approx. two times greater in volume than the remaining water left in the suction tube 5 and discharge tube 6 is supplied from the hot water supplying tube 12. Thereby, the remaining water in the suction tube 5 and discharge tube 6 can be completely discharged, whereby a sanitary state in the suction tube 5 and discharge tube 6 can be maintained. Next, after the remaining water discharged into a bathtub 2 is further discharged through the bathtub plug 2*a,* the bathtub plug 2*a* is closed, and hot water or cold water is supplied into the bathtub 2 through the faucet 27, whereby bathing is made possible.

Also, instead of discharging the remaining water left in the suction tube 5 and discharge tube 6 into a bathtub 2, the suction portion 17 and bubble jetting and discharging member 22 are disposed outside the bathtub 2, whereby the remaining water may be discharged through a discharge port of the bathroom. In this case, bath water may be supplied into the bathtub 2 in advance, and after the remaining water left in the suction tube 5 and discharge tube 6 is discharged when commencing use of the bubble jetting apparatus 1, the suction portion 17 and bubble jetting and discharging member 22 are placed outside the bathtub 2, the bubble jetting apparatus 1 may be used.

In addition, in a case where, in a bathroom of a hotel or the like, bath water whose temperature is regulated can be supplied into the bathtub 2 directly from a faucet 27, the hot water supplying tube 12 of the bubble jetting apparatus 1 is connected to piping of the faucet 27, wherein bath water may be supplied into the bathtub 2 via the hot water supplying tube 12 and discharge tube 6. Further, when connecting the hot water supplying tube 12 to the piping of the faucet 27, hot water can be supplied into not only a hot water supplying tube 12 but also a shower, etc., if the hot water supplying tube 12 is connected via a change valve separately provided.

Next, as a user commences bathing by utilizing a bubble jetting action of the bubble jetting apparatus 1, the change valves 10, 14 and 15 are opened, and the circulating pump 4 and compressor 8 are driven and started by the drive portion 11. As the circulating pump 4 starts to drive, bath water in the bathtub 2 is sucked by the suction portion 17, and is supplied into the suction tube 5 and discharge tube 6. Further, as the compressor 8 is driven and started, compressed air is supplied from the compressor 8 into the air supplying chamber 25 via the compressor air supplying tube 9, and bubbles are discharged from the bubble discharging holes 26 into bath water in the discharge tube 6.

Next, the bath water in which bubbles are mixed (called "bubble jets") is discharged from the bubble jetting and discharging port 22*a* of the bubble jetting and discharging member 22 via the discharge tube 6, bubble jetting and discharging tube 18, and flexible tubular member 21.

Also, the user may use the bubble jets while applying the bubble jets to any optional position of his or her body by orienting the bubble jetting and discharging member 22 to an optional portion such as the shoulders, waist, legs, etc.

Next, a description is given of a case where a member having two bubble jetting and discharging ports is used as the bubble jetting and discharging member 22, with reference to the accompanying drawings.

Figure 5:
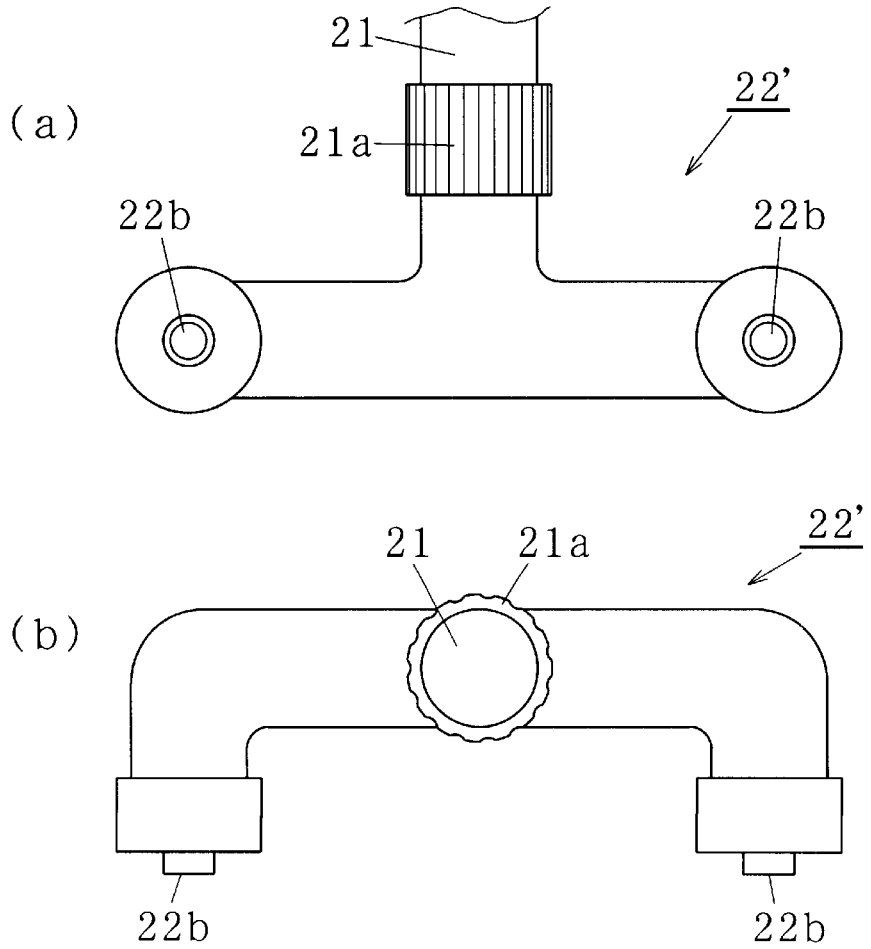

FIG. 5(*a*) is a elevational view showing the major parts of a bubble jetting and discharging member having two bubble jetting and discharging ports in the first embodiment, and FIG. 5(*b*) is a plan view of the major parts in FIG. 5(*a*).

In FIG. 5, 22' indicates a bubble jetting and discharging member having two bubble jetting and discharging ports 22*b,* and 21*a* is a screw-in portion in which the flexible tubular member 21 and bubble jetting and discharging member 22' are detachably screwed. Where using and applying bubble jets to the shoulders, waist, etc., the bubble jetting and discharging members 22' may be connected for use to the flexible tubular member 21 instead of the bubble jetting and discharging member 22.

Next, a description is given of a case where the bubble jetting and discharging member 22 or 22' is fixed in a bathtub 2 and used therein, with reference to the following drawings.

Figure 6:
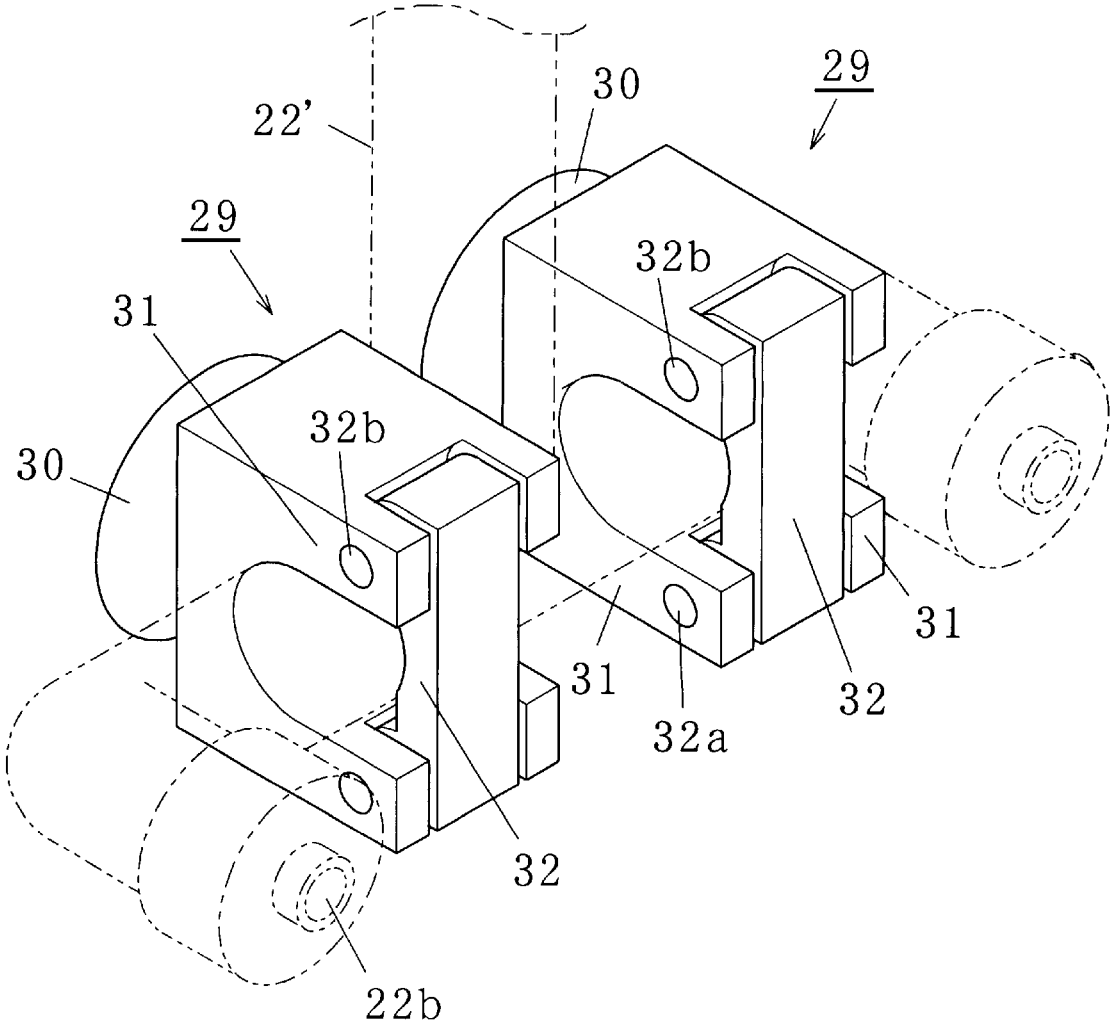
FIG. 6 is a perspective view of a fixing member by which a bubble jetting and discharging member of the first embodiment are fixed in a bathtub.

FIG. 6 is a perspective view of a fixing member by which a bubble jetting and discharging member according to the first embodiment is fixed in a bathtub.

In FIG. 6, 29 indicates a fixing member which fixes the bubble jetting and discharging member 22 or 22', 30 indicates a sucking-disk, attached to the fixing member 29, which is detachably adsorbed on the inner wall of a bathtub 2 and wall surface of the bathroom, etc. 31 indicates a holder portion which is formed so as to be roughly U-shaped on the fixing member 29 and where the bubble jetting and discharging member 22 or 22' is engaged with and fixed at the fixing member. 32 indicates a fixing portion which is openably disposed at the holder portion 31 and prevents the bubble jetting and discharging member 22 or 22' engaged with the holder portion 31 from dropping. 32*a* indicates a pivotal supporting portion which pivotally supports one end of the fixing member 32 at the end portion of the holder portion 31. 32*b* indicates an inserting pin by which the other end of the fixing portion 32 is detachably fixed at the holder portion 31. The fixing member 29 is adsorbed on an appointed portion of the inner wall of a bathtub 2 and wall surface of a bathroom. The bubble jetting and discharging member 22 or 22' is fixed at the fixing member 29, as shown in FIG. 6, by closing the fixing portion 32 after the member 22 or 22' is engaged with and fixed at the holder portion 31 by opening the fixing portion 32 of the fixing member 29. In addition, instead of fixing the other end at the holder portion 31 by using the inserting pin 32*b*, those in which the fixing portion 32 can be attached to or detached from the holder portion 31 with a one-touch operation using a latch, etc., may be used as the fixing portion 32.

Since a bubble jetting apparatus according to the first preferred embodiment is constructed as described above, the following actions can be brought about.

(1). Since the bubble jetting apparatus is provided with an extended suction tube, one end of which is disposed in a bathtub, connected to the suction tube disposed in the apparatus body, and a bubble jetting and discharging tube connected to the discharge tube, the apparatus body can be installed beneath a washbowl, etc., inside or outside a bathroom apart from the bathtub, wherein since no wide installation space is required for the corresponding bubble jetting apparatus, and since the apparatus body is not installed in a bathtub, the apparatus body does not constitute any obstacle, and use convenience can be improved.

(2). Since the apparatus body is installed beneath a washbowl, etc., in a bathroom, the suction portion at the end portion of the extended suction tube is disposed in a bathtub, and the bubble jetting and discharging portion connected to the bubble jetting and discharging tube is disposed around the bathtub therein, etc., it is possible to easily attach the corresponding bubble jetting apparatus to an existing bathtub even after the bathtub is once installed.

(3). Since a filtrating portion is provided in the suction portion disposed at the end portion of the extended suction tube, floating matter such as hair, etc., contained in bath water sucked in by the suction portion can be caught by the filtrating portion, that is, it is possible to filtrate the bath water, whereby floating matter can be prevented from flowing into the suction tube, etc., circulating pump and discharge tube, and the sanitary state of the bubble jets can be improved.

(4). Since an air supplying chamber of the bubble generating portion connected to the compressor is disposed in the discharge tube, bubbles discharged from the bubble discharging holes of the air supplying chamber are supplied into bath water in the discharge tube to cause bubbles to be mixed in the bath water, whereby bubble jets can be discharged from the bubble jetting and discharging port of the bubble jetting and discharging member, and massages or the like can be made available by bubble jets by orienting the bubble jetting and discharging port to the shoulders, waist, legs, etc.

(5). Since the circulating pump and compressor are connected to one drive portion, the drive portion can be prevented from becoming large-sized, whereby the apparatus body can be made small-sized.

(6). Since the bubble generating portion is provided with a compressed air supplying tube connected to the compressor, an air supplying chamber connected to the compressed air supplying tube and disposed in the discharge tube, and bubble discharging holes drilled into the circumferential wall of the air supplying chamber, bubbles can be supplied into the discharge tube by only driving the compressor, wherein the structure is simple, whereby productivity can be improved, and maintenance efficiency can be improved.

(7). Since the air jetting and discharging portion has a detaching portion formed at one end of the bubble jetting and discharging tube, a flexible tubular member detachably connected to the detaching portion, and a bubble jetting and discharging member connected to the flexible tubular member, it is possible to connect the bubble jetting and discharging portion to the bubble jetting and discharging tube by only connecting the flexible tubular member to the detaching portion, and at the same time, the bubble jetting and discharging portion can be removed when not using the same. Accordingly, use efficiency can be improved.

(8). Since the bubble jetting and discharging member is connected to the detaching portion via a flexible tubular member, it is possible to orient the bubble jetting and discharging member to any optional portion of the shoulders, waist, legs, etc., of a user, whereby use efficiency can be further improved.

(9). Since the apparatus body is provided with a fixing member by which a sucking-disk can be adsorbed on the inner wall of a bathtub or wall surface of a bathroom, it is possible to fix the bubble jetting and discharging member by the fixing member, wherein the bubble jetting and discharging member can be used in a fixed state without manually holding the same during use of the corresponding bubble jetting apparatus. In particular, where a fixing member is adsorbed at a high place on a wall surface of a bathroom, etc., and the bubble jetting and discharging member is fixed thereat, bubble jets can be used as massaging water, wherein use efficiency can be improved, and the massage effect can also be improved.

(10). Since hot water can be supplied from the hot water supplying tube to the suction tube and discharge tube when commencing drive of the corresponding bubble jetting apparatus, the remaining water left in the suction tube and discharge tube can be discharged, whereby the remaining water in the suction tube and discharge tube is not circulated, and it is not discharged into the bath water. Therefore, a sanitary state can be improved.

(11). Since a hot water supplying tube connected to the suction tube is provided, the circulating pump can be driven after the suction tube and discharge tube are filled with hot water when commencing to drive of the corresponding bubble jetting apparatus, whereby stability of the circulating pump can be maintained when commencing the operation.

(12). Since the bubble jetting apparatus is provided with change valves connected to the hot water supplying tube and change valves disposed at the suction tube, by only changing the change valves, hot water can be supplied to the suction tube, bath water can also be supplied to the suction tube and discharge tube, and hot water and bath water can be supplied to appointed tubes.

(13). Since the compressed air supplying tube is provided with a change valve, it is possible to securely prevent hot water from flowing into the compressed air supplying tube when supplying hot water from the hot water supplying tube into the discharge tube.

(14). Where a bubble jetting and discharging member have two bubble jetting and discharging ports, it is possible to apply bubble jets to two points even in a wide range from the shoulders to the waist, etc., at one time, and the massage effect can be increased by the bubble jets.

(15). Since the bubble jetting and discharging member is detachably screwed in the screw-in portion at the end portion of a flexible tubular member, it is possible to easily replace a bubble jetting and discharging member having one bubble jetting and discharging port with that having two bubble jetting and discharging ports according to application portions, etc., whereby use efficiency can be improved.

(16). Since a check valve is provided in the compressed air supplying tube and hot water supplying tube, it is possible to securely prevent hot water in the discharge tube and suction tube from inversely flowing into the compressed air supplying tube and hot water supplying portion, wherein safety can be improved.

(17). Since a suction preventing member, which is formed greater than the suction portion and is outwardly fitted to the suction portion, is provided, the suction area of the suction portion can be widened, whereby such a state can be effectively prevented, where a towel or the like is sucked to the suction portion to clog the suction portion, suction of bath water by the suction portion is hindered, and the circulating pump is subjected to water-free operations. Therefore, it is possible to prevent the circulating pump from being impaired, whereby durability of the circulating pump can be improved.

(Second preferred embodiment)

A description is given of a bubble jetting apparatus according to a second preferred embodiment of the invention, with reference to the accompanying drawings.

Figure 7:
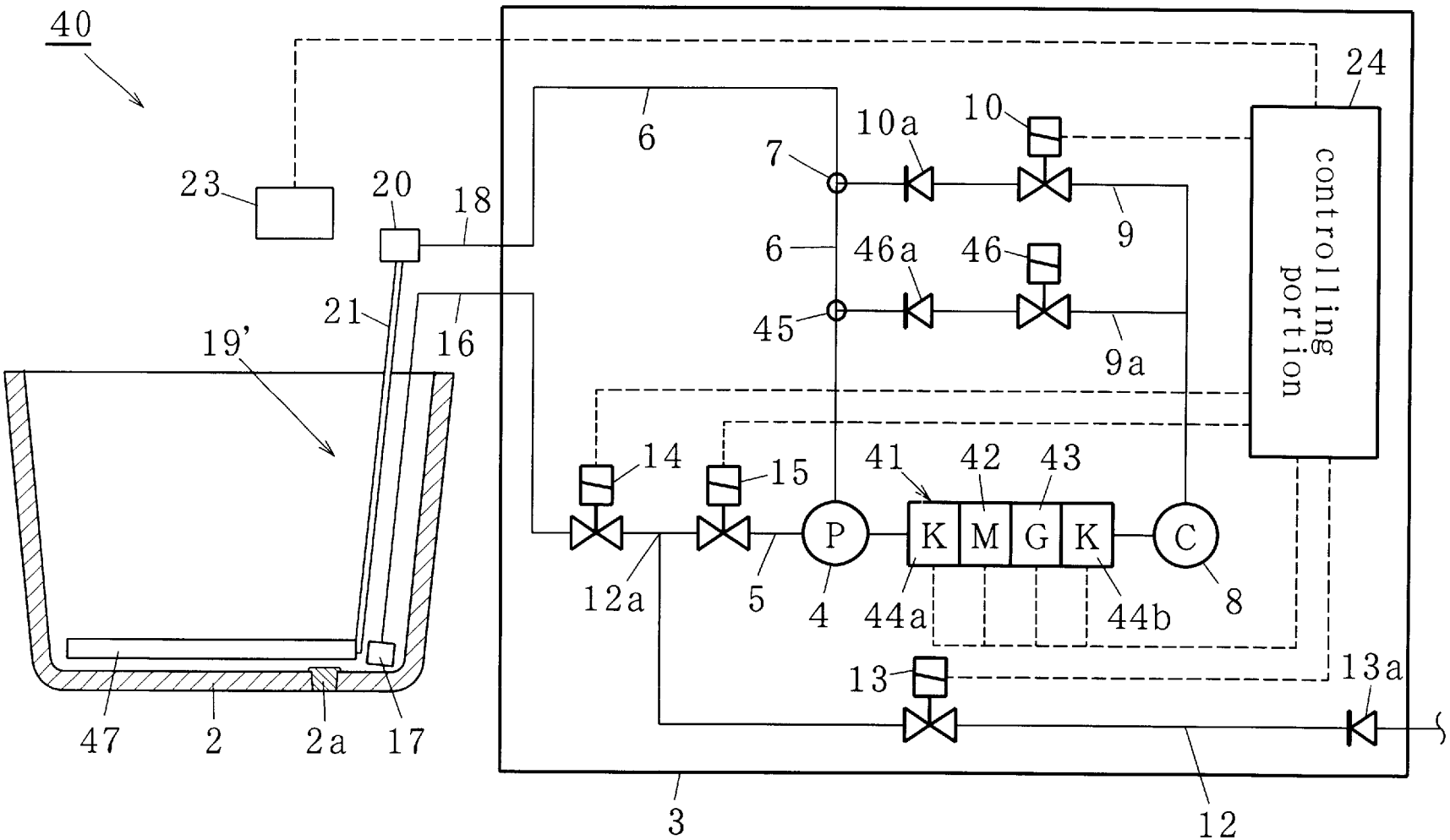
FIG. 7 is an explanatory view of a bubble jetting apparatus according to a second preferred embodiment.

FIG. 7 is an explanatory view of a bubble jetting apparatus in compliance with the second preferred embodiment. Parts which are identical to those of the first preferred embodiment are given the same reference numbers, and overlapping description thereof is omitted.

In FIG. 7, 40 indicates a bubble jetting apparatus in the second preferred embodiment. 41 indicates a drive portion that is connected to the circulating pump 4 and compressor 8 and drives the circulating pump 4 and compressor 8. 43 indicates a speed reducer to which a motor 42 and compressor 8 are connected. 44*a* indicates a clutch to which the motor 42 and circulating pump 4 are connected. 44*b* indicates a clutch to which the motor 42 and compressor 8 are connected via a speed reducer 43. 45 indicates a bubble generating portion disposed in the discharge tube 6 and connected to the compressor 8, 9*a* indicates a compressed air supplying tube of the bubble generating portion 45, which is connected to the compressed air supplying tube 9. 46 indicates a change valve of the bubble generating portion 45, which is disposed at the compressed air supplying tube 9*a*, 46*a* indicates a check valve disposed at the compressed air supplying tube 9*a* at the discharge tube 6 side of the change valve 46. 19' indicates a bubble jetting and discharging portion connected to the bubble jetting and discharging tube 18. 47 indicates a hollow mat-like bubble jetting and discharging member which is connected to the flexible tubular member 21 and is disposed on the bottom of a bathtub 2.

Herein, an electromagnetic clutch, mechanical clutch, electric clutch, hydraulic clutch, etc., may be used as clutches 44*a* and 44*b*. Also, any one of either clutch 44*a* or 44*b* may be omitted, wherein if the clutch 44*b* is omitted, bubble bathing or bubble jet bathing is made possible by driving only the compressor 8 or simultaneously driving the circulating pump 4 and compressor 8, and if the clutch 44*a* is eliminated, jet bathing or bubble jet bathing is made possible by driving only the circulating pump 4 or simultaneously driving the circulating pump 4 and compressor 8. Also, a speed accelerator may be provided between the motor 42 and clutch 44*a* instead of the speed reducer 43.

In the second preferred embodiment, as the bubble generating portion 45, an air supplying chamber having a plurality of bubble discharging hole portions drilled on the circumferential wall thereof is connected to the compressed air supplying tube 9 and is provided in the discharge tube 6 as in the bubble generating portion 7. In addition, the size of the bubble discharging holes is made smaller than that of the bubble discharging holes 26 of the bubble generating portion 7, but the number thereof is further increased than the latter.

Further, a porous body made of ceramic, etc., is connected to the compressed air supplying tube 9*a* instead of the air supplying chamber, and may be disposed in the discharge tube 6. Thereby, small bubbles can be supplied into the discharge tube 6.

Figure 8:
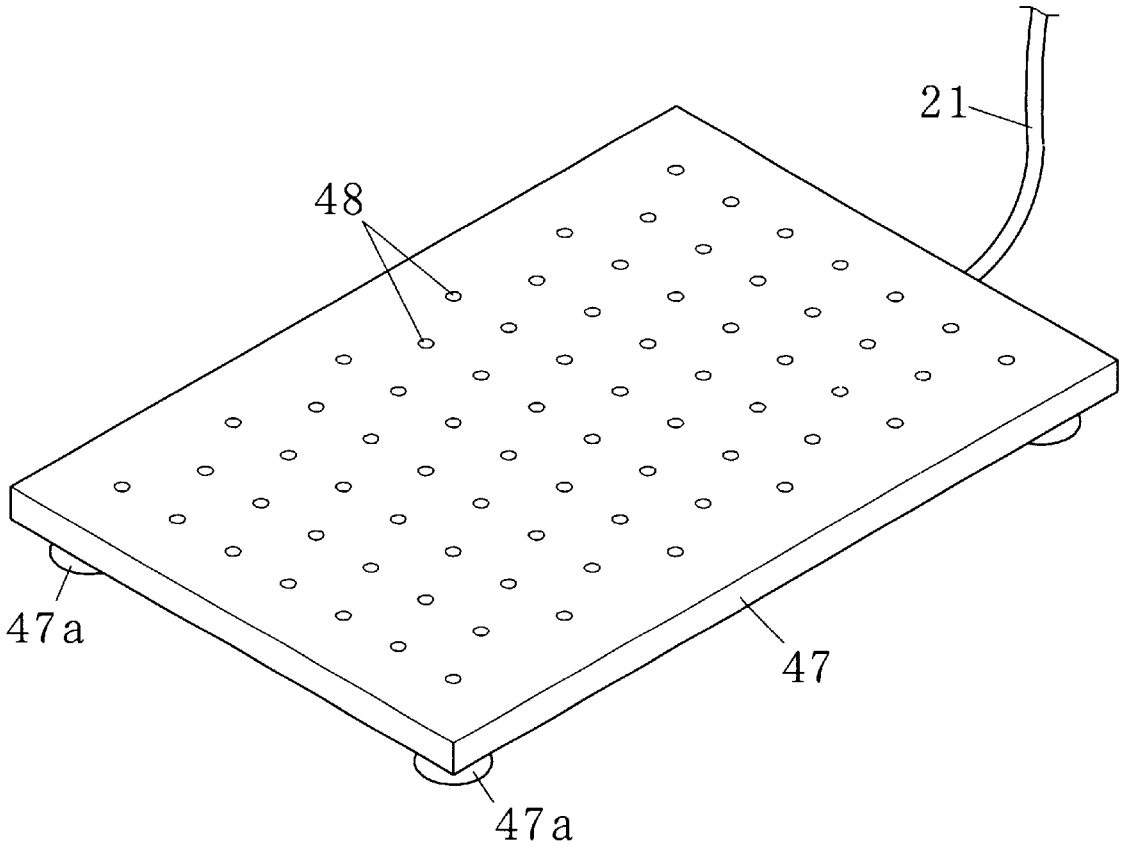
FIG. 8 is a perspective view showing a bubble jetting and discharging member of a bubble jetting and discharging port in the second embodiment.

Next, a description is given of a bubble jetting and discharging member of the bubble jetting and discharging portion according to the second preferred embodiment, with reference to the following drawings:

FIG. 8 is a perspective view of a bubble jetting and discharging member of the bubble jetting and discharging portion according to the second preferred embodiment.

In FIG. 8, 47*a* indicates a fixing member consisting of a sucking-disk, which is disposed beneath the bubble jetting and discharging member 47 and is adsorbed on the inner wall of a bathtub 2. 48 indicates a plurality of bubble jetting and discharging ports drilled on the upper surface of the bubble jetting and discharging member 47. Also, it is preferable that the bubble jetting and discharging ports 48 are formed nozzle-like. In particular, where air is discharged from the bubble jetting and discharging port 48 into bath water in the bathtub 2, it is possible to smoothly discharge air from the bubble jetting and discharging port 48 as bubbles.

A bubble jetting apparatus 40 thus constructed according to the second preferred embodiment may be used in a bathtub in a hotel or the like with its apparatus body 3 installed in a bathroom or a washroom, etc., adjacent to the bathroom as in the first preferred embodiment.

Next, a description is given of actions of the bubble jetting apparatus 40.

Where the circulating pump 4 and compressor 8 are connected to the motor 41 via clutches 44*a* and 44*b* of the drive portion 41, after the remaining water left in the suction tube 5 and discharge tube 6 is discharged by a remaining water discharging action of the bubble jetting apparatus 40 as in the first preferred embodiment, the change valve 10 and/or 46, change valves 14 and 15 are opened, and the change valve 13 is closed, wherein the circulating pump 4 and compressor 8 are driven and started by the motor 42 in line with commencement of a bubble jet bathing action. By drive of the circulating pump 4, bath water is supplied into the suction tube 5 and discharge tube 6, and compressed air is supplied from the compressor 8 into the compressed air supplying tubes 9 and 9*a* by drive of the compressor 8. And, bubbles are supplied from the bubble generating portion 7 and/or bubble generating portion 45 into bath water in the discharge tube 6, whereby bubble jets are discharged from the bubble jetting and discharging port 48 of the bubble jetting and discharging member 47 via the discharge tube 6, bubble jetting and discharging tube 18, and flexible tubular member 21.

Also, instead of connecting the bubble jetting and discharging portion 19' to the bubble jetting and discharging tube 18, the bubble jetting and discharging portion 19 described in the first preferred embodiment is connected to the bubble jetting and discharging tube 18, and bubble jets maybe discharged, as in the first preferred embodiment, from the bubble jetting and discharging ports 22*a* and 22*b* of the bubble jetting and discharging members 22 and 22'.

Herein, where large bubbles are supplied into bath water in the discharge tube 6, large-diametered bubbles are supplied from the bubble generating portion 7 into the discharge tube 6 with the change valve 10 open and the change valve 46 closed, and where small-diametered bubbles are supplied, small-diametered bubbles are supplied from the bubble generating portion 7 into the discharge tube 6 with the change valve 10 closed and the change valve 46 open. In addition, where large- and small-diametered bubbles are supplied into the discharge tube 6, small and large bubbles are supplied from the bubble generating portion 7, 45 into the discharge tube 6 with both the change valves 10 and 46 open.

In addition, the amount of discharge of bubbles and the discharge pressure of bubble jets can be adjusted by controlling by the speed reducer 43.

In a case where the circulating pump 4 is connected to the motor 42 of the drive portion 41 via the clutch 44*a*, and the motor 42 and compressor 8 are not connected, as the bubble jetting apparatus 40 is driven and started by commencement of a jet bathing action, the change valves 10 and 46 are closed, and the change valves and 14 and 15 are opened, whereby the circulating pump 4 is driven and started by the motor 42. By drive of the circulating pump 4, bath water in a bathtub 2 is sucked in by the suction portion 17, passes through the suction tube 5 and discharge tube 6, and bubble jets are discharged from the bubble jetting and discharging port 48 of the bubble jetting and discharging member 47 into the bathtub 2 via the bubble jetting and discharging tube 18 and flexible tubular body 21.

Also, instead of connecting the bubble jetting and discharging portion 19' to the bubble jetting and discharging tube 18, the bubble jetting and discharging portion 19 described in the first preferred embodiment is connected to the bubble jetting and discharging tube 18, whereby bubble jets may be discharged from the bubble jetting and discharging ports 22*a* and 22*b* of the bubble jetting and discharging members 22 and 22'.

In addition, it is possible to freely regulate the discharge pressure of jets by controlling by the speed reducer 43.

In a case where the compressor 8 is connected to the motor 42 of the drive portion 41 via the clutch 44*b* and the speed reducer 43, and the motor 42 and circulating pump 4 are not connected, if the bubble jetting apparatus 40 is driven and started by commencement of a bubble bathing action, the change valves 10 and/or 46 are opened, and the change valves 14 and 15 are closed, wherein the compressor 8 is driven and started by the motor 42 to cause air to be supplied from the bubble generating portion 7 and/or bubble generating portion 45 into the discharge tube 6, and is supplied, as bubbles, from the bubble jetting and discharging port 48 of the bubble jetting and discharging member 47 into bath water in a bathtub 2 via the bubble jetting and discharging tube 18, and flexible tubular member 21.

Herein, remaining water discharge and various features such as a bubble jet bathing, a jet bathing, and a bubble bathing can be selected by changing the clutches 44*a* and 44*b*, and the discharge pressure and discharge amount of bubble jets, jet streams, and bubbles can be controlled or the like by varying a drive force by the speed reducer 43. All these operations can be carried out by the operating portion 23.

Since a bubble jetting apparatus according to the second preferred embodiment is constructed as described above, the following actions can be brought about in addition to the effects mentioned with respect to the first preferred embodiment.

(1). Since the drive portion is provided with clutches and the motor is connected to the circulating pump and compressor via clutches, any one of either of only the circulating pump, only the compressor, or both the circulating pump and compressor can be selected and driven by changing the clutches, whereby it is possible to freely select any one of either feature of only jet streams, only bubbles, or bubble jets by the corresponding bubble jetting apparatus.

(2). Since the drive portion is provided with a speed reducer or a speed accelerator, the circulating pump and compressor can be driven by one motor, whereby the drive portion can be made small-sized, and any universal type of motor may be employed.

(3). Since providing with a plurality of bubble generating portions discharge different sizes of bubbles, it is possible to easily change the size of bubbles in compliance with usage.

(4). Since the bubble jetting and discharging portion consists of a hollow mat-like bubble jetting and discharging member which is connected to a flexible tubular member, disposed on the bottom of a bathtub, and has a bubble jetting and discharging port on the upper surface thereof, it is possible to discharge bubbles, jet streams, and bubble jets from the bottom of a bathtub into bath water in the bathtub. In particular, by discharging bubbles, bubble bathing can be enjoyed in an existing bathtub.

(5). Since a fixing member consisting of a sucking-disk is provided on the underside of the bubble jetting and discharging member, the sucking-disk is adsorbed onto a bathtub when the bubble jetting and discharging member is disposed on the bottom of the bathtub, whereby the bubble jetting and discharging member can be fixed, and it is possible to prevent the bubble jetting and discharging member from moving during use. In addition, it is possible to fix the bubble jetting and discharging member on not only the bottom of the bathtub but also the side wall of the bathtub, etc., thereby improving use efficiency.

According to a bubble jetting apparatus thus constructed, the following excellent effects can be achieved.

According to the invention as described in Aspect 1, (1). Since a circulating pump and compressor are connected to one drive portion, no individual drive portion is not required for drive of the circulating pump and compressor, whereby the drive portion can be made small-sized, the apparatus itself can be made small-sized, and no wide space is required to install the apparatus body. Therefore, it is possible to easily install the apparatus body in an existing bathroom or outside the bathroom in a hotel, a house, an apartment house, etc., and the application is excellent.

(2). Since a bubble generating portion connected to the compressor is provided at an appointed portion in the discharge tube in the apparatus body, bubbles can be mixed in bath water in the discharge tube by only driving the compressor to generate bubble jets, wherein the structure of the bubble generating portion can be simplified, and can be made small-sized. Therefore, production efficiency and maintenance are excellent.

(3). In a case where a plurality of bubble generating portions are provided, the size of bubbles and amount of supplying bubbles can be adjusted in compliance with usage, and massage effect can be improved.

According to the invention as described in Aspect 2, in addition to the effect as set forth in Aspect 1, (4). Since a bubble jetting apparatus is provided with an extended suction tube portion having one end thereof disposed in bath water in a bathtub, and a bubble jetting and discharging tube connected to the discharge tube, the extended suction tube portion is disposed in a bathtub, whereby the bubble jetting and discharging tube is disposed in a bathtub or in the vicinity of the bathtub, and the apparatus body can be installed in a bathroom outside the bathtub or outside the bathroom. It is not necessary to install the apparatus body in a bathtub as in prior arts. Therefore, the apparatus body does not hinder bathing, etc., whereby use efficiency can be improved.

(5). The extended suction tube portion is disposed in a bathtub, the bubble jetting and discharging tube is disposed in a bathtub and in the vicinity of the bathtub, and the apparatus body is disposed in a bathroom outside the bathtub or outside the bathroom, whereby the corresponding bubble jetting and discharging apparatus can be installed. Therefore, a power source, etc., can be easily secured or the like, and the apparatus body can be easily installed in a short time. Further, it is possible to easily attach the apparatus body to an existing bathtub after the bathtub is once completed. No replacement of the bathtub and no installation work such as pipings, etc., are required. The apparatus is excellent in view of installation and application.

According to the invention as described in Aspect 3, in addition to effects as specified in Aspect 1 or 2, (6). In a case where a clutch is provided between the drive portion and the circulating pump and/or compressor, it is possible to change the clutch to any one of either drive of only the circulating pump, drive of only the compressor, or drive of both the circulating pump and compressor. Therefore, it is possible to freely select any one of either jet streams by drive of the circulating pump, bubbles by drive of the compressor, and bubble jets by drive of both the circulating pump and compressor, and the bubble jetting apparatus can be applied to various applications such as bubble bathing, jet stream bathing, and bubble jet bathing by the corresponding bubble jetting apparatus, whereby use efficiency can be further improved.

(7). In a case where the drive portion is provided with a speed reducer and speed accelerator, a drive force necessary to drive the circulating pump and compressor can be obtained by one unit of the drive portion, whereby application range of the drive portion can be widened, and the drive portion can be then made small-sized.

(8). By changing the number of revolutions of the circulating pump and compressor, it is possible to freely adjust the discharge amount of bubbles, and discharge pressure of jet streams and bubble jets. Therefore, the shoulders, waist, legs, etc., to which bubbles, jet streams and bubble jets discharged from the bubble jetting and discharging portion are applied, can be freely selected, and the respective features of the apparatus can be adjusted on the basis of usage. Accordingly, use efficiency is excellent.

(9). Since the discharge amount of bubbles, and discharge pressure of jet streams and bubble jets can be adjusted by controlling said number of revolutions, whereby a massage effect can be improved by bubble bathing, jet stream bathing or bubble jet bathing, and the same effects as those of a prior art bubble jetting apparatus installed integral with a bathtub can be brought about.

According to the invention described in Aspect 4, in addition to effects as specified in Aspects 1 through 3, (10). Since the bubble generating portion includes a compressed air supplying tube connected to the compressor, and an air supplying chamber connected to the compressed air supplying tube, disposed in the discharge tube and having a bubble discharging hole portion on the circumferential wall, the compressed air can be supplied into the air supplying chamber by only driving the compressor, where by bubbles can be discharged from the bubble discharging hole portion to the discharging tube. Therefore, structure is simple, and bubbles can be easily supplied into the discharge tube.

(11). The structure of the bubble generating portion is simple, and the production efficiency can be further improved, and the apparatus is excellent in view of maintenance.

According to the invention as described in Aspect 5, in addition to the effects as described in Aspects 1 through 4, (12). Since the corresponding bubble jetting apparatus is provided with a hot water supplying tube connected to the suction tube, hot water can be supplied to the suction tube and discharge tube via the hot water supplying tube, and the remaining water left in the suction tube and discharge tube can be discharged when driving and starting the corresponding bubble jetting apparatus. No remaining water is permitted to be circulated and to be discharged in bath water in a bathtub. Therefore, the apparatus is excellent in view of hygiene.

(13). Since hot water can be supplied into the suction tube and discharge tube when driving and starting the corresponding bubble jetting apparatus, stability in drive of the circulating pump can be maintained particularly in a case where a non-self type pump is employed as the circulating pump.

(14). Since change valves are disposed in the hot water supplying tube and/or suction tube, it is possible to supply hot water supplied from the hot water supplying tube to appointed portions of the suction tube and discharge tube by only changing the change valves.

According to the invention as described in Aspect 6, in addition to effects as specified in Aspects 1 through 5, (15). Since the bubble jetting and discharging portion is provided with a flexible tubular member and a bubble jetting and discharging member, the bubble jetting and discharging member can be used by freely moving it to any optional position inside or outside a bathtub, etc., by using the flexible tubular member, bubbles, jet streams or bubble jets can be applied to the shoulders, waist, legs, etc., of a user. Therefore, use efficiency is excellent.

What is claimed is:

1. A bubble jetting apparatus provided with

A. an apparatus body, comprising (a) a circulating pump;

(b) a suction tube connected to the suction side of said circulating pump;

(c) a discharge tube connected to the discharge side of said circulating pump;

(d) one or more bubble generating portions disposed at an appointed position of said discharge tube, comprising a compressed air supplying tube having one end thereof connected to a compressor, an air supplying chamber connected to said compressed air supplying tube and disposed in said discharge tube, and bubble discharging holes drilled on the circumferential wall of said air supplying chamber;

(e) a compressor connected to said bubble generating portions; and (f) a drive portion connected to said circulating pump and said compressor, B. an extended suction tube portion, an end of which is disposed in bath water in a bathtub, connected to said suction tube;

C. a bubble jetting and discharging tube connected to said discharge tube; and

D. a bubble jetting and discharging portion connected to said bubble jetting and discharging tube.

2. A bubble jetting apparatus provided with

A. an apparatus body, comprising (a) a circulating pump;

(b) a suction tube connected to the suction side of said circulating pump;

(c) a discharge tube connected to the discharge side of said circulating pump;

(d) one or more bubble generating portions disposed at an appointed position of said discharge tube;

(e) a compressor connected to said bubble generating portions;

(f) a drive portion connected to said circulating pump and said compressor;

(g) a hot water supplying tube, one end of which is connected to said suction tube, and the other end of which is connected to a hot water supplying portion; and (h) a change valve disposed at said hot water supplying tube and/or said suction tube, B. an extended suction tube portion, an end of which is disposed in bath water in a bathtub, connected to said suction tube;

C. a bubble jetting and discharging tube connected to said discharge tube; and

D. a bubble jetting and discharging portion connected to said bubble jetting and discharging tube.

3. A bubble jetting apparatus provided with

A. an apparatus body, comprising (a) a circulating pump;

(b) a suction tube connected to the suction side of said circulating pump;

(c) a discharge tube connected to the discharge side of said circulating pump;

(d) one or more bubble generating portions disposed at an appointed position of said discharge tube;

(e) a compressor connected to said bubble generating portions; and (f) a drive portion connected to said circulating pump and said compressor;

B. an extended suction tube portion, an end of which is disposed in bath water in a bathtub, connected to said suction tube;

C. a bubble jetting and discharging tube connected to said discharge tube; and

D. a bubble jetting and discharging portion connected to said bubble jetting and discharging tube, comprising a flexible tubular body connected to said bubble jetting and discharging tube, and a bubble jetting and discharging member connected to said flexible tubular body.

4. A bubble jetting apparatus as set forth in claim 3, wherein said bubble jetting and discharging member is a hollow mat-like bubble jetting and discharging member having a plurality of bubble jetting and discharging ports drilled on the upper surface thereof.

5. A bubble jetting apparatus provided with

A. an apparatus body, comprising (a) a circulating pump;

(b) a suction tube connected to the suction side of said circulating pump;

(c) a discharge tube connected to the discharge side of said circulating pump;

(d) one or more bubble generating portions disposed at an appointed position of said discharge tube, comprising a compressed air supplying tube having one end thereof connected to a compressor, an air supplying chamber connected to said compressed air supplying tube and disposed in said discharge tube, and bubble discharging holes drilled on the circumferential wall of said air supplying chamber;

(e) a compressor connected to said bubble generating portions;

(f) a drive portion connected to said circulating pump and said compressor;

(g) a clutch equipped between said drive portion, and said circulating pump and/or said compressor, B. an extended suction tube portion, an end of which is disposed in bath water in a bathtub, connected to said suction tube;

C. a bubble jetting and discharging tube connected to said discharge tube; and

D. a bubble jetting and discharging portion connected to said bubble jetting and discharging tube.

6. A bubble jetting apparatus as set forth in claim 5, wherein either a speed reducer or a speed accelerator is equipped between said drive portion, and said circulating pump and/or said compressor via said clutch.

7. A bubble jetting apparatus as set forth in claim 1 or 5, further comprising a hot water supplying tube, one end of which is connected to said suction tube, and the other end of which is connected to a hot water supplying portion, and a change valve disposed at said hot water supplying tube and/or said suction tube.

8. A bubble jetting apparatus as set forth in any one of claim 1, 2 or 5, wherein said bubble jetting and discharging portion comprises a flexible tubular body connected to said bubble jetting and discharging tube, and a bubble jetting and discharging member connected to said flexible tubular body.

9. A bubble jetting apparatus as set forth in claim 8, wherein said bubble jetting and discharging member is a hollow mat-like bubble jetting and discharging member having a plurality of bubble jetting and discharging ports drilled on the upper surface thereof.

* * * * *